United States Patent [19]

Stubben et al.

[11] 4,189,145

[45] Feb. 19, 1980

[54] APPARATUS FOR CONTINUOUS ROTATION SIMULATION OF VIDEO IMAGES

[75] Inventors: David R. Stubben, Santa Clara; Dennis J. Koble, Cupertino, both of Calif.

[73] Assignee: Atari, Inc., Sunnyvale, Calif.

[21] Appl. No.: 871,601

[22] Filed: Jan. 23, 1978

[51] Int. Cl.[2] ..... A63F 9/02

[52] U.S. Cl. ..... 273/313; 35/25; 273/DIG. 28

[58] Field of Search ..... 35/11 R, 11 A, 10.2, 35/12 N, 25; 340/324 AD; 358/104; 273/101.2, DIG. 28, 85 G

[56] References Cited

U.S. PATENT DOCUMENTS

| | | | |
|---|---|---|---|
| 3,234,665 | 2/1966 | Sear et al. | 35/12 N X |
| 3,517,121 | 6/1970 | Petrocelli et al. | 35/25 X |
| 3,539,696 | 11/1970 | Sweeney et al. | 35/12 N X |
| 3,621,131 | 11/1971 | Wolff | 35/11 A X |
| 3,691,284 | 9/1972 | Borjeson | 35/25 X |
| 3,711,826 | 1/1973 | LaRussa | 35/12 N X |
| 3,728,480 | 4/1973 | Baer | 273/101.2 |
| 3,793,483 | 2/1974 | Bushnell | 273/DIG. 28 |
| 3,900,703 | 8/1975 | Tickle | 35/12 N X |

*Primary Examiner*—Vance Y. Hum

*Attorney, Agent, or Firm*—Townsend and Townsend

[57] ABSTRACT

A periscope in a submarine type video game is simulated where there is a correspondence between the actual motion of the rotation of the periscope produced by the player and the perceived motion on the video screen which is observed by the player. Various ships cross the screen which are targets of the game. The apparatus generates several ships at one time throughout a panoramic view and the player by rotation may bring any one of these ships into his actual more narrow field of view.

8 Claims, 6 Drawing Figures

APPARATUS FOR CONTINUOUS ROTATION SIMULATION OF VIDEO IMAGES

CROSS REFERENCE TO RELATED APPLICATION

Reference is made to patent application entitled GAME FOR SIMULATING SUBMARINE CONNING STATION filed Nov. 17, 1977, Ser. No. 852,434, in the name of Phillip C. Kearney and assigned to the present assignee.

BACKGROUND OF THE INVENTION

The present invention is directed to apparatus for the continuous rotation simulation of images on a video display screen and more specifically to a video amusement game which simulates the periscope column at the conning tower of a submarine.

Amusement games have been provided which include a periscope or view port where the game player by proper aim can fire torpedos at ships. However, the target area was always fixed and there was no perception by the player that he was looking at one segment of a panoramic view as would be true in a real submarine.

OBJECTS AND SUMMARY OF THE INVENTION

It is therefore a general object of the present invention to provide apparatus for the continuous rotation simulation of video images.

In accordance with the above object, there is provided apparatus for the continuous rotation simulation of images on a video display screen. The apparatus comprises means for mounting the display screen for rotation about a predetermined axis and for simultaneous viewing by the viewer. Objects suitable for actual display on said screen are generated, the objects having virtual angular bearings in a plane perpendicular to the axis. These objects thus provide an effective panoramic view. Video generation means display at least one of the objects on the video screen and provide an effective field view much smaller than the panoramic view. Means are provided for sensing rotary movement of the display screen. Such rotary movement of the display screen is compared with the bearings of the generated objects for causing the actual display of an object if it is within the field of view.

DESCRIPTION OF PREFERRED EMBODIMENTS

Figure 1:
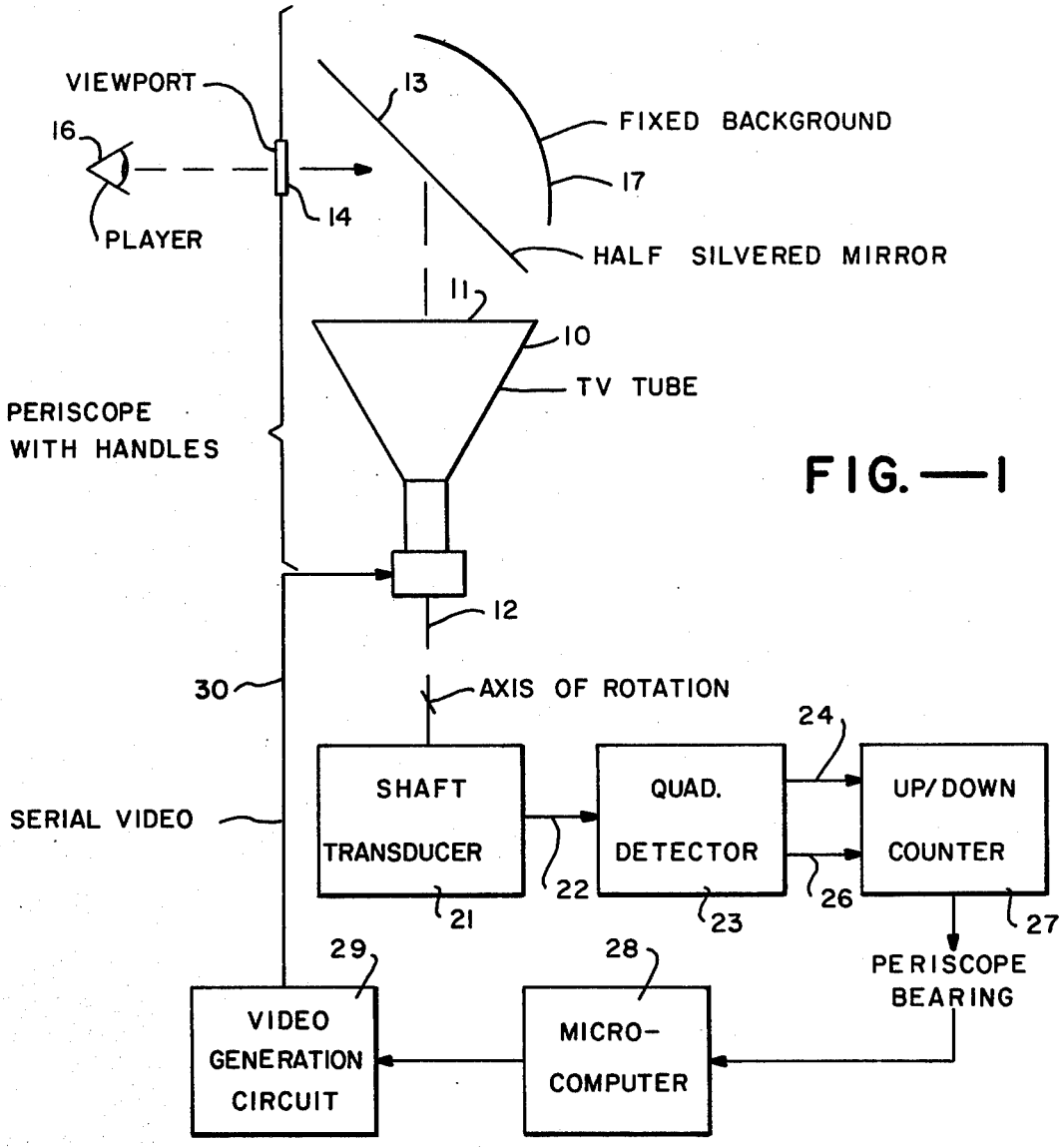
FIG. 1 is a partially diagramatic, partially block diagram view of apparatus embodying the present invention.

Referring now to FIG. 1 which shows in diagrammatic form the mechanical configuration of the invention (and which is shown in full detail in the above referenced Kearney application), a television tube 10 having a display screen 11 is mounted for rotation about an axis 12. A mirror 13 provides for viewing of the video display screen 11 through a view port 14, which is only diagramatically illustrated, for use by a viewer or player 16. A fixed background is provided at 17 by means of half silvering mirror 13.

The entire mechanical combination effectively serves as a simulated periscope which may be rotated around its axis of rotation almost a full circle. Actually, the rotation is 300° to allow for simplified wiring to the electrical components. As the periscope is rotated the player moves their body with the periscope in order to remain in front of view port 14. As will be discussed below, the images or objects provided on display screen 11 move in a 1:1 correspondence with the movement of the player and thus cause a correspondence between actual and perceived motion.

The amount of rotary motion is sensed by a shaft transducer 21 coupled by some mechanical means to the axis of rotation 12 (see copending Kearney application) which produces on its output line 22 a pair of quadrature signals. As is well known in the art a quadrature detector 23 generates incremental pulses in accordance with the amount of movement of the periscope. Moreover, its output lines 24 and 26 indicate in a well known manner the direction of movement. The two incremental signals on lines 24 and 26 drive up/down counter 27 which thus stores an accumulated count which is indicative of the total rotary movement of the periscope. Or, in other words, its angular bearing with respect to a plane perpendicular to the axis 12.

As will be discussed in greater detail below, a microcomputer 28 processes such bearing information and develops an appropriate video signal by means of a video generation unit 29. Serial video output line 31 drives television tube 10. This video generation unit may be identical to that described and claimed in a copending application entitled APPARATUS FOR CONTINUOUS VARIATION OF OBJECT SIZE ON A RASTER TYPE SCREEN, Ser. No. 809,314, filed June 23, 1977 in the names of Mayer and Milner and assigned to the present assignee now U.S. Pat. No. 4,107,665 issued Aug. 15, 1978.

Figure 2:
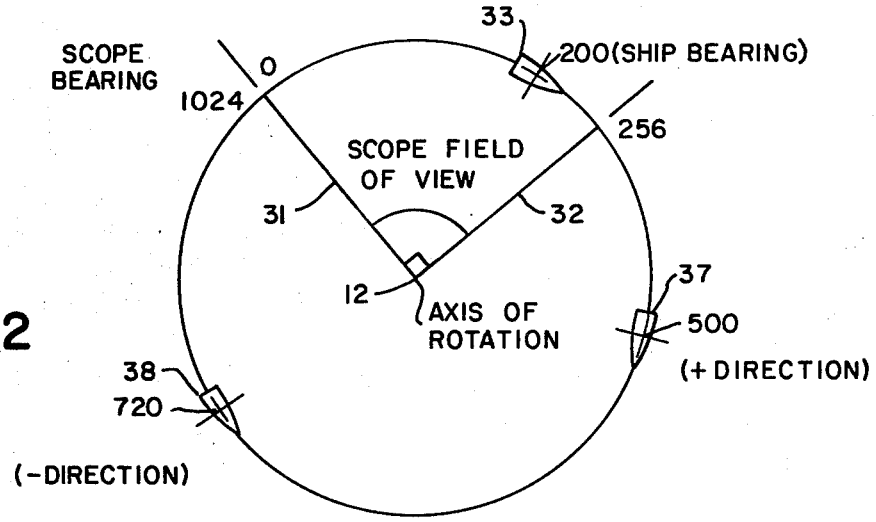
FIG. 2 is a diagrammatic view useful in understanding the operation of the present invention.

FIG. 2 illustrates the output of the shaft transducer 21 and the final accumulated count of counter 27. Here the periscope is shown as being located at its reference 0 (which the shaft transducer 21 can easily provide) and then in a clockwise direction counter 27 provides 1024 counts for a full 360° (or more realistically, 300°) of rotation.

Figure 3A:
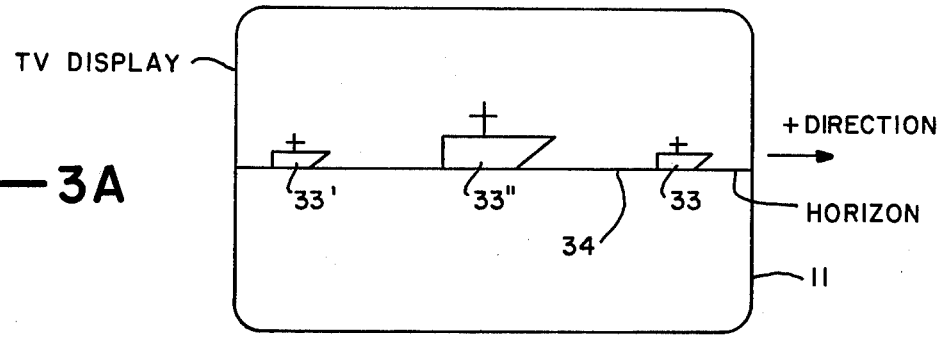
FIG. 3A is an illustration of a video display seen in the present invention.

The effective field of view of the periscope is indicated by the field of view lines 31 and 32 which of course is actually the display on the video screen 11. This is indicated as being a count of 256. Referring to FIG. 3A this correspondence comes about since a horizontal line of video display screen 11 is provided with 256 resolution elements (viz, a horizontal scan rate of 6 MHz). Thus movement of the periscope, which produces an incremental count of 1, will shift the display one resolution element. Thus there is a 1:1 correspondence between actual motion and perceived motion for almost a full rotation of 360°

However, it should be kept in mind that a high resolution shaft transducer could give either a smaller field of view or a higher video resolution. In other words, though a 1:1 correspondence is desirable, the invention contemplates a 2:1 correspondence, etc. All that is necessary is to give the illusion of a panoramic view so that the player or viewer at any one time is looking at a relatively small portion of the view in the periscope viewport. This simulates the actual conning tower in a submarine.

Figure 3B:
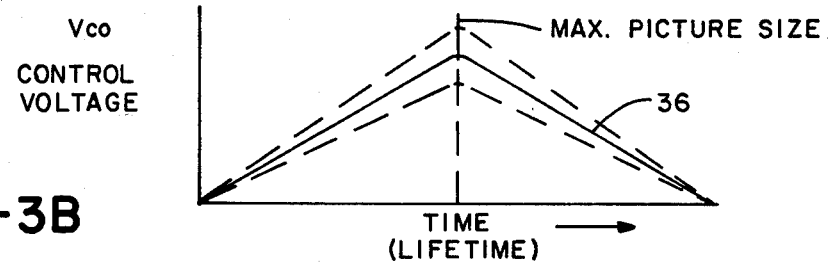
FIG. 3B is characteristic curves useful in understanding the invention.

As illustrated in FIG. 2 and also referring to FIG. 3A, a ship 33 is illustrated at a bearing of 200. Since it is in the field of view (between lines 31, 32) it would be displayed on the television display 11 on the ocean horizon 34. Thus the ship might appear on the display screen 11 at the location shown. Assuming that the periscope had not been moved, such a ship might have originated on the left side of the screen as shown at 33' proceeded to the middle of the screen at 33" where it has been expanded in size and finally move off to the right where it has been reduced in picture size at 33. Thus, this would simulate a ship seeming to appear from a far off distance, then drawing closer where perhaps in accordance with the game rules a torpedo is fired at it by means of aiming sight and then if not sunk the ship moves off in the distance and thus decreases in size. Such a change in size is illustrated by the curves of FIG. 3B and specifically curve 36. Variation in size is determined by maximum picture size data which is provided by the microcomputer 28 which varies a voltage control oscillator which varies picture size as fully disclosed and claimed in the copending Mayer and Milner application. As illustrated in FIG. 3B, there is a family of maximum picture sizes in order to produce variations in where ships appear to have traversed the screen. The ship has a lifetime which would normally exceed the time for its normal traverse across the video display screen. This is to prevent the ship from being artifically extinguished or flickering out. Such lifetime is of course dependent on absolute time and its speed across the screen.

Referring briefly again to FIG. 2, as will be discussed below, while one ship 33 is displayed on the display screen 11, other ships have been generated as illustrated at 37 and 38 which since they are not displayed on the video screen are merely theoretical creations of microcomputer 28 as far as the video generation circuit 29 is concerned and thus the respective bearings of 500 and 720 are virtual angular bearings only. However, if the scope is suddenly moved so that the bearing of the ship is within range or in the field of view of the scope, this video generation circuit will be activated to actually produce that ship on the screen.

Figure 4:
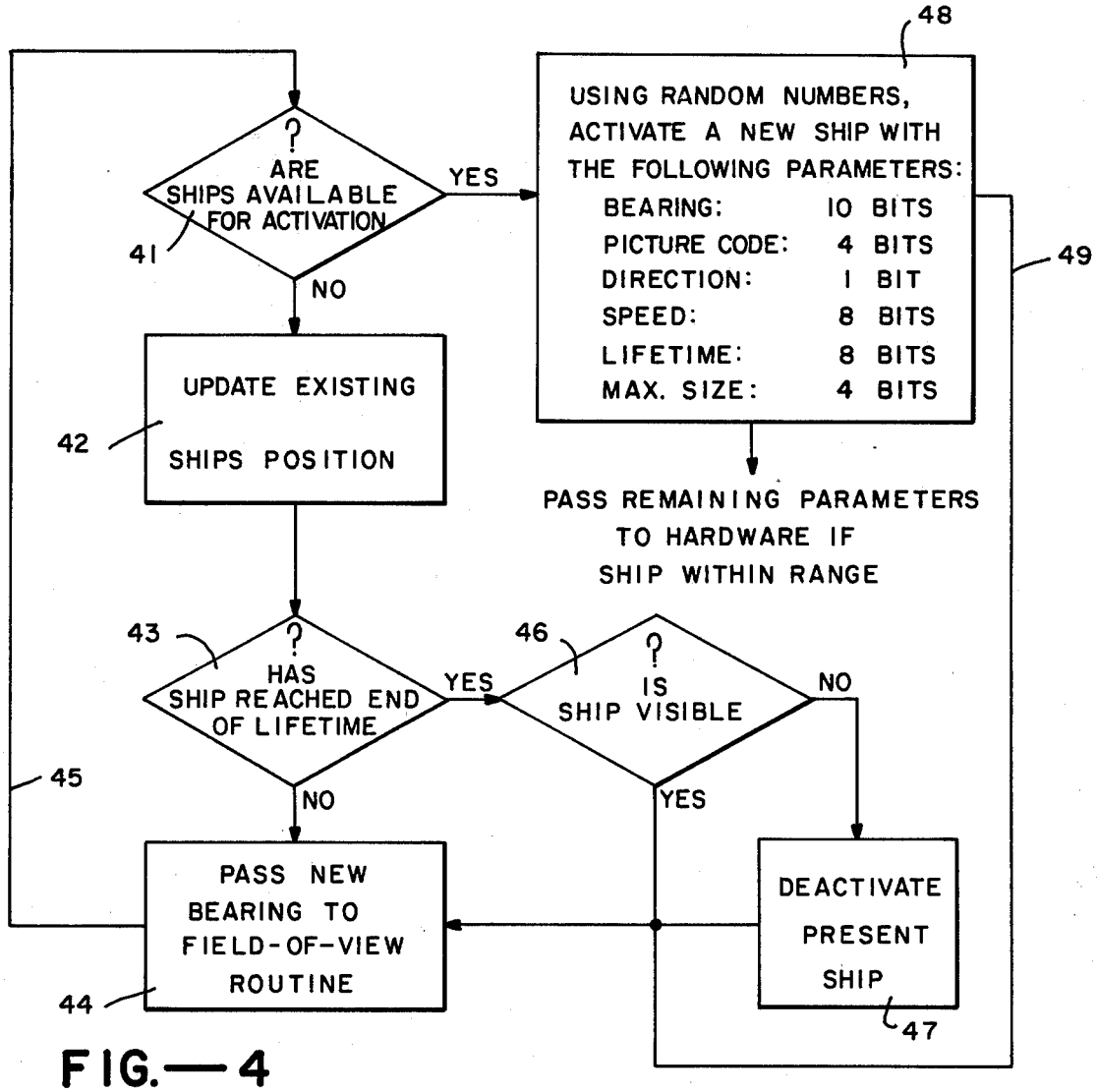
FIG. 4 is a flow chart used in the present invention.

FIG. 4 illustrates the flow chart used in the "theoretical" generation of objects or ships. The flow chart is of course determined by a read only memory program which is part of microcomputer 28. Specifically in block 41, the question is asked, "Are ships available for activation?" This is dependent on how many ships are desired to be available to the game player. In the present embodiment there are two cruisers and one PT boat. Assuming the three ships indicated in FIG. 2 are all active, the answer would be "No" and the next block 42 is "Update existing ship's position". In other words, the ship is moving across the screen with a certain speed and this would be updated by the microcomputer. The updated position will of course change the bearing of the ship and thus in block 44 the new bearing is passed to a field of view routine which is actually FIG. 5. And moreover, by means of the return line 45, this routine is gone through for all of the ships.

However the foregoing will occur only if the question of block 43, "Has ship reached end of lifetime?" is answer "No". In the present game the normal lifetime of all ships is 4.096 seconds. Specifically an eight bit binary number (256 decimal) is counted down once every video frame of 16 milliseconds.

In order to prevent a ship from suddenly disappearing from perhaps the middle of the field of view its lifetime is extended until it exits the field either by the player moving his periscope or the motion of the ship itself carrying it "off-screen". This might occur because a player is following a ship by rotating the periscope and since the ship will have reached a minimum size, and will not disappear entirely because of practical considerations in the video hardward generation circuit, the realism of the game is preserved by preventing the ship from disappearing abruptly. Thus, if there is a "Yes" answer to block 43 as to "end of lifetime", the question "Is ship visible?" is asked in block 46. In order to answer this question a call is made to the field-of-view subroutine of FIG. 5. If "Yes", the lifetime number is incremented by "1" and the new bearing passed (block 44). If "No", the ship is deactivated via block 47.

Thus to deactivate a ship two concurrent conditions must occur: (1) it has reached the end of its "lifetime" and (2) it is invisible.

Referring again to the decision block 41, if ships are available for activation, the operational box 48 is accomplished here. A random number generator is used to activate the new ship with the parameters of bearing, picture code, direction, speed, lifetime and maximum size. The number of digital bits for this information is also given in block 48. Bearing data is passed via line 49 to block 44 so that, referring to FIG. 2, a ship might be indicated as being at the bearing 500. Since there are 1024 increments, 10 bits are required to produce the bearing data in binary notation. Type of ship, that is PT boat or cruiser, is designated by the 4 bit picture code which activates a graphics generator shown in the Mayer and Milner copending application. The one bit direction is effectively a reflection bit which as illustrated in FIG. 2 provides for plus or minus direction of, for example, ships 37 and 38. Also referring to FIG. 3A, the ships are indicated as going across the screen in a plus direction. The speed of the ships, which is 8 bits of information, will affect the updating of the ship's position shown in block 42, which is related to the frame rate of the television display. The "lifetime" parameter is an absolute time indication and has been discussed. Finally, maximum size, referring to FIG. 3B, is determined by the object size as it reaches the center of its effective lifetime.

In any case, even though a new object is activated and its bearing is known, all the other parameters which would be used to drive the video generation circuit 29 are not actually used until that specific ship is in the field of view.

Figure 5:
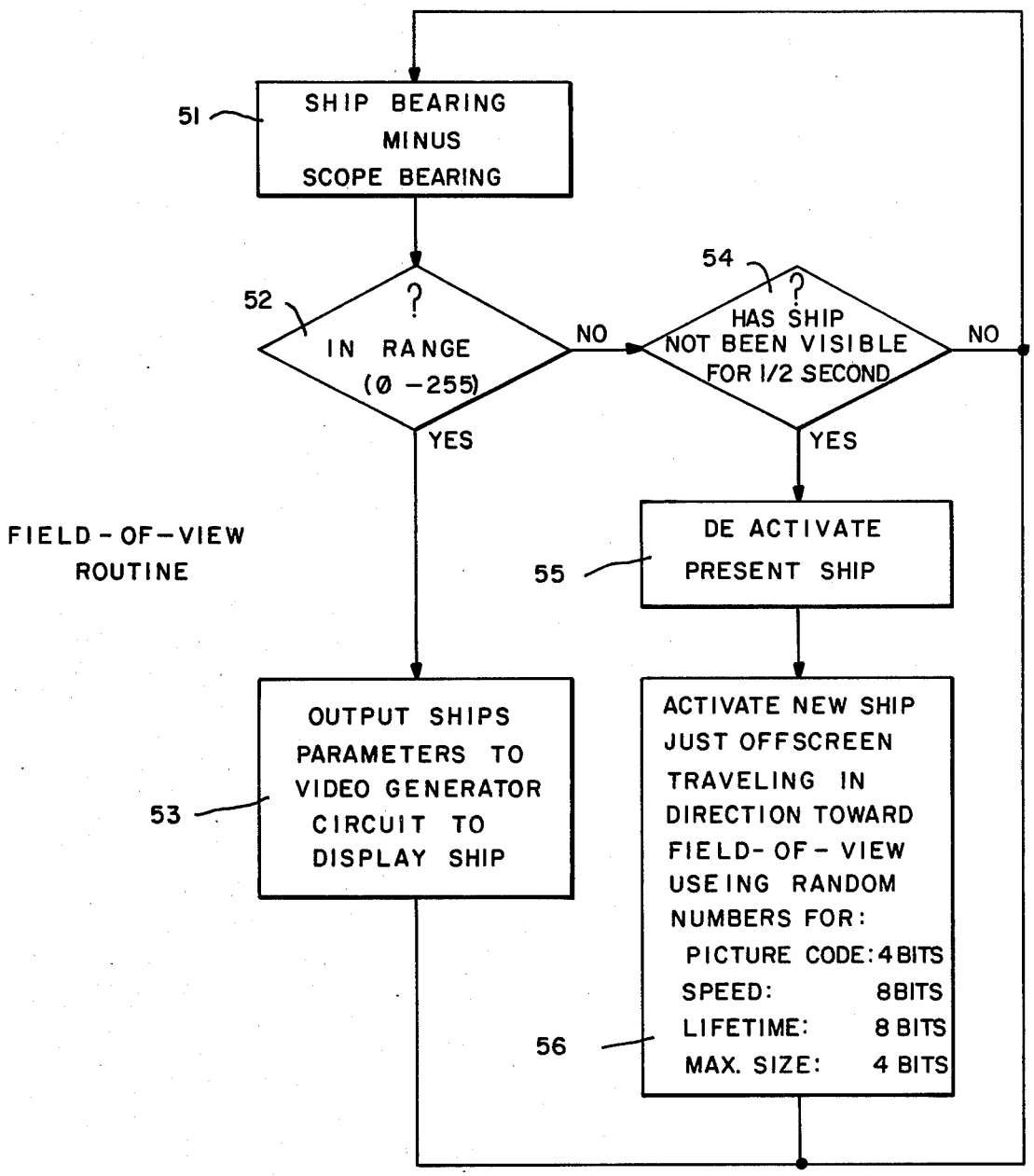
FIG. 5 is another flow chart used in the present invention.

The foregoing is illustrated in FIG. 5 where in a decision block 51 the actual scope bearing for example is 0 in FIG. 2, is subtracted from the ship's virtual bearing. If it is within the 256 unit angular range (block 52), and therefore by definition within the field of view, the remaining parameters of this ship, designated in FIG. 4, cause the video generation circuit to display the ship (block 53). If not in range the field of view routine of FIG. 5 is repeated for other ships and in any case is repeated per frame.

However in order to enhance the periscope simulation of the present video game, several additional features are provided by the microcomputer program.

For example, there is a one-half second time delay when a ship has moved off the screen to prevent deactivation (because its lifetime is over) so that the player might rotate the periscope to again place the ship in the field of view. This is provided by block 54. If, however, the ship has been invisible for more than ½ second, it is deactivated (block 55) and a new ship is activated just off-screen travelling in a direction toward the field of view (block 56). The direction in which the periscope is turning is also taken into account by sensing two sequential bearings. This feature provides a more interesting game. As illustrated in block 56 the other four necessary parameters of picture code, speed, lifetime and maximum size are determined as before.

Finally another game feature is that the size control circuit also controls a brightness level so that as the ship size increases its brightness will increase.

Thus to summarize the invention, there are two distinct phases of operation. First, a given number of ships, for example three, which is limited only by available computer storage, are activated at various times along an imaginary horizon. Each of the ships is given a direction of either clockwise or counterclockwise, a speed, a picture code which accesses a picture read only memory which has various ship's picture, a lifetime and a bearing along the horizon. For each of these ship's positions is regularly updated by adding or subtracting a fixed amount to the ship's virtual bearing. When the fixed lifetime of this ship is reached it will be deactivated and another ship with different parameters will be activated to take its place and thus produce game variety. In the second phase of operation, the periscope has a bearing which may be increased or decreased by the player turning the periscope either clockwise or counterclockwise. It allows the player a 90° field of view on the ocean and thus will allow a player to see one fourth the total allowable panoramic view at any one time. On a regular basis, the periscope bearing is compared to each of the ship's bearings. If a periscope bearing is ever found to be within the viewing range of one of the ships, that ship's picture code and horizontal position on the screen are transmitted to the video generation hardware and appears on the video screen. This all occurs within one frame video frame time so it appears to the viewer to be instantaneous. Thus, the present invention allows the player to scan a substantially 360° ocean by moving the periscope either clockwise or counterclockwise, to have various ships appear in his field of view, and moreover to travel through it.

What is claimed is:

1. A video game apparatus for the continuous rotation simulation of images on a video display screen comprising: means for mounting said display screen for rotation about a predetermined axis and for simultaneous viewing by said viewer; means for generating movable objects suitable for actual display on said screen, said objects having virtual angular bearings in a plane perpendicular to said axis, such objects at said bearings providing an effective panoramic view; video generation means for displaying at least one of said objects on said video screen and providing an effective field of view much smaller than said panoramic view; means for sensing rotary movement of said display screen; and means for comparing said rotary movement of said display screen with said bearings of said generated objects and for causing the actual display of an object whenever said object is within said field of view, said movable object generating means including means for changing said virtual angular bearings of said movable objects at a predetermined rate so that said objects have a predetermined normal display lifetime, means for extending said display lifetime whenever said lifetime has expired and said movable object is presently displayed, said lifetime extending means including predetermined time period means for prohibiting deactivation of said movable object after moving outside of said field of view, and means for deactivating the display of a previously displayed movable object whenever the corresponding predetermined display lifetime has been exceeded and said previously displayed movable object has been outside said field of view beyond said predetermined time period.

2. Apparatus as in claim 1 where said panoramic view consists of the substantial portion of a circle.

3. Apparatus as in claim 2 where said circle portion is 300° and said field of view is 90°.

4. Apparatus as in claim 1 where said means for generating objects is responsive to said rotary movement of said display screen for shifting a displayed object to provide a correspondence between actual and perceived motion.

5. Apparatus as in claim 4 where said video generation means provides a video display with a predetermined number of resolution elements and said means for sensing rotary movement provides an incremental movement signal for each resolution element.

6. Apparatus as in claim 5 where there are 256 resolution elements in a video line and 256 incremental signals are generated for 90° of rotation which is said field of view.

7. Apparatus as in claim 1 including means for generating a new object with a virtual angular bearing near said field of view whenever a previously displayed object has been deactivated.

8. The combination of claim 1 wherein said movable object generating means includes means for varying the size of at least one of said movable objects in accordance with the predetermined normal display lifetime in order to provide dynamic movable object perspective.

* * * * *